US005974668A

United States Patent [19]

Butzer

[11] Patent Number: 5,974,668

[45] **Date of Patent: *Nov. 2, 1999**

[54] IRISING CIGAR CUTTER

[76] Inventor: Dane C. Butzer, 1380 Harrison Pond Dr., New Albany, Ohio 43054

[ * ] Notice: This patent issued on a continued prosecution application filed under 37 CFR 1.53(d), and is subject to the twenty year patent term provisions of 35 U.S.C. 154(a)(2).

[21] Appl. No.: 08/802,027

[22] Filed: Feb. 18, 1997

[51] Int. Cl.[6] ..... A24C 5/12

[52] U.S. Cl. ..... 30/112; 30/110; 30/173; 30/279.2; 83/646

[58] Field of Search ..... 30/109, 111, 112, 30/110, 95, 173, 240, 265, 299, 279.2; 83/646; 426/503, 518; 264/148

[56] References Cited

U.S. PATENT DOCUMENTS

| | | | |
|---|---|---|---|
| 2,717,440 | 9/1955 | Anacker | 30/95 X |
| 2,951,411 | 9/1960 | Subilia | 83/618 X |
| 3,759,127 | 9/1973 | Mills | 83/646 X |
| 3,903,598 | 9/1975 | Lefebvre | 30/109 X |
| 3,954,033 | 5/1976 | Tipton et al. | 83/646 X |
| 4,475,938 | 10/1984 | Knoth | 83/646 X |
| 4,767,304 | 8/1988 | Tashiro | 426/518 |
| 4,767,305 | 8/1988 | Tashiro | 426/503 X |
| 5,223,277 | 6/1993 | Watanabe et al. | 83/646 X |
| 5,694,691 | 12/1997 | Chen | 30/111 X |

*Primary Examiner*—Rinaldi I. Rada
*Assistant Examiner*—Charles Goodman

[57] ABSTRACT

The cigar cutter (1) has a housing (2), an opening (3) adapted for insertion of a cigar or the end of a cigar, at least three blades (5), and a squeeze bar (6). When the cigar cutter (1) is squeezed, for example by the pressure of a single hand on the squeeze bar (6) and the side of the housing (2) opposite the squeeze bar (6), a mechanism translates the squeezing force into an irising movement of the blades (5). The mechanism includes rings (11), squeeze bar pins (15), and blade pins (21). The inside diameters of the rings (11) are less than that of the opening (3). Part of the end of the squeeze bar (6) protrudes into the housing (2) and is forked so as to sandwich the rings (11). Squeeze bar pins (15) extend from the rings (11) and pass through slots (17) in the forked end of the squeeze bar (6). By means of this arrangement, an inward movement of the squeeze bar (6) causes the rings (11) to rotate. The blade pins (21) connect the rings (11) and pass through slots (22) in the blades (5), which are mounted on pivot pins (23). Thus, the rotation of the rings (11) moves the blades pins (21) and thereby swings the blades (5) on the pivot pins (23), irising the blades across the opening (3) much as a camera shutter irises closed.

19 Claims, 5 Drawing Sheets

IRISING CIGAR CUTTER

BACKGROUND—FIELD OF THE INVENTION

The present invention concerns a cigar cutter in which at least three blades iris closed so as to cut a cigar. In particular, the invention concerns a cigar cutter wherein a squeezing force applied to at least one squeeze bar irises the blades closed, thereby cutting the cigar.

BACKGROUND—DESCRIPTION OF THE ART

Many cigar cutters exist in which one or two blades push through a cigar. Such cutters can be appropriately called guillotine or double-guillotine cutters. These type of cutters suffer from the deficiency that they can crush, squash, or otherwise deform the cigar as they cut it. They can also tear the wrapper leaf or the endcap of the cigar as the blades are forced through the cigar.

As described in U.S. Pat. No. 3,903,598, another type of cigar cutter exists in which a part of the cigar cutter can be pivotally displaced with respect to another part of the cigar cutter. In the course of this pivoting movement, the cutter's blades are subjected to a rotational movement corresponding to the pivoting movement and concurrently to a translational movement, thus progressively effecting the cutting of the cigar. In the alternative, the cigar cutter includes a lever that is turnable through an angle of 70° to 80°. By pivoting the lever, the cutter's blades are moved circularly in a hypocycloidal path. Both embodiments produce a peripheral cutting action at the same time that the blades penetrate into the cigar.

In view of the art, a need exists for a cigar cutter in which the application of a squeezing force causes the cutter's blades to cut a cigar in a manner intended to avoid substantial deformation and tearing of the cigar.

SUMMARY OF THE INVENTION

An object of the invention is to fulfill the foregoing needs with a cigar cutter (or a general purpose cutter) in which a squeezing force is translated into an irising motion of the cutter's blades.

In one aspect, the invention is a cigar cutter including a housing with at least an opening adapted for insertion of a cigar, a squeeze bar, and at least three blades. The squeeze bar is connected to the blades in a manner such that a squeezing force applied to the squeeze bar irises the blades closed, thereby cutting a cigar inserted into the opening. Preferably, the squeezing force can be applied with a single hand in which the cigar cutter fits.

In another aspect, the invention is a cigar cutter including a housing with at least an opening large enough for at least partial insertion of a cigar, a squeeze bar, a mechanism connected to the squeeze bar, and at least three blades connected to the mechanism. The squeeze bar is disposed in the housing such that a squeezing force that sqeezes the squeeze bar toward the housing imparts a movement to the squeeze bar. The mechanism translates the movement of the squeeze bar into an irising movement of the blades, thereby cutting a cigar inserted into the opening.

In another aspect, the invention is a cutter including a housing with at least an opening adapted for insertion of an object, a squeeze bar, a mechanism connected to the squeeze bar, and at least three blades connected to the mechanism. The mechanism translates a movement of the squeeze bar into an irising movement of the blades, thereby at least partially cutting an object inserted into the opening.

In another aspect, the mechanism of the invention that translates a movement of the squeeze bar into an irising movement of the blades includes two rings that sandwich the blades, at least one squeeze bar pin extending from at least one of the two rings and passing through the squeeze bar, and at least one blade pin for each of the blades. Each blade pin connects the two rings and passes through at least one of the blades.

DETAILED DESCRIPTION OF THE PREFERRED EMBODIMENT

Figure 1:
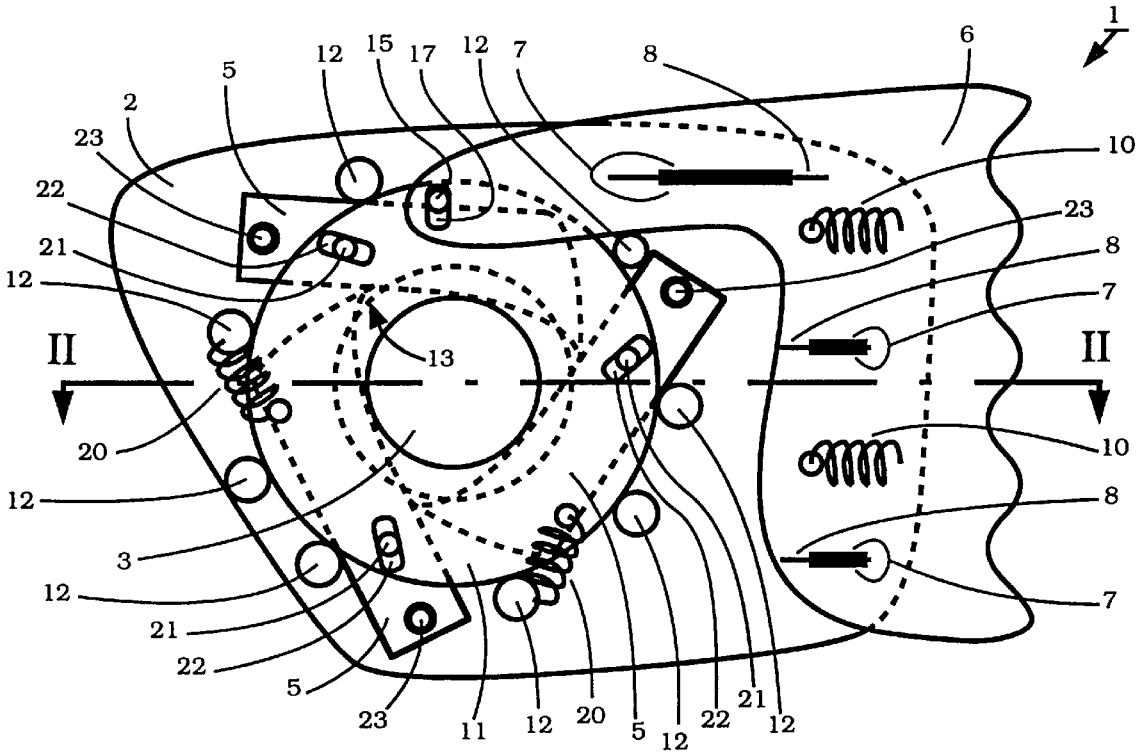
FIG. 1 is a cut-away view of a cigar cutter illustrative of a preferred embodiment of the invention.
Figure 2:
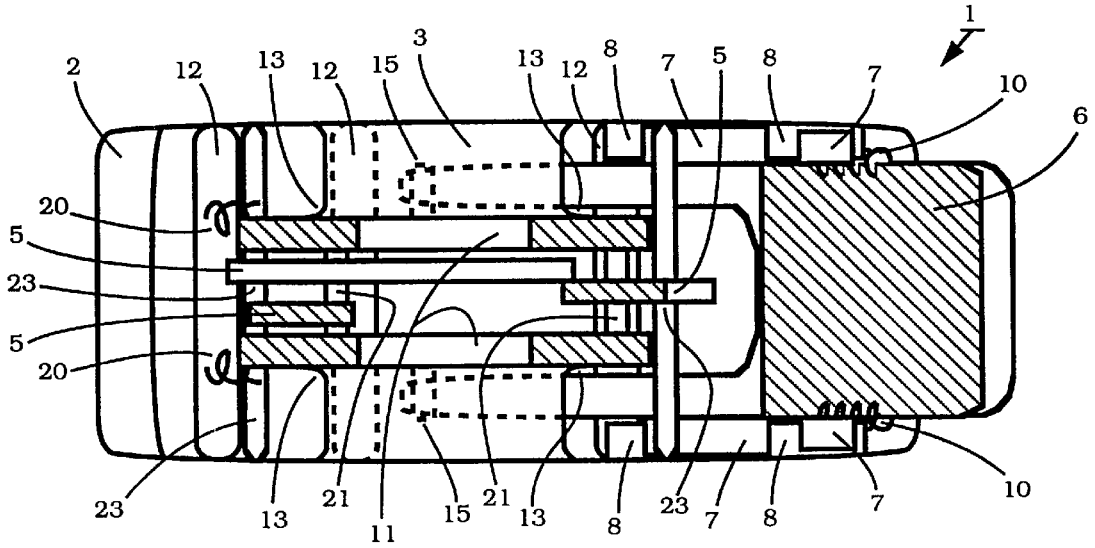
FIG. 2 is a cut-away view along line II—II of FIG. 1.

FIG. 1 is a view of cigar cutter 1, which is illustrative of a preferred embodiment of the invention, with the top part of housing 2 cut-away. FIG. 2 is a cut-away view along line II—II of FIG. 1. The top part of housing 2 is not cut-away in FIG. 2. In addition, the thicknesses of the parts shown in FIG. 2 are exaggerated for clarity. In the preferred embodiment, the entire cutter is relatively thin, preferably less than one half of an inch thick.

As shown in FIGS. 1 and 2, cigar cutter 1 has opening 3 adapted for insertion of a cigar or the end of a cigar (not shown). Part of housing 2 encircles and extends partially into opening 3. Note that the only hidden lines shown in FIG. 2 are those hidden by this part of housing 2.

Cigar cutter 1 also has at least three blades 5 and squeeze bar 6. When cigar cutter 1 is squeezed, for example by the pressure of a single hand on squeeze bar 6 and the side of housing 2 opposite squeeze bar 6, a mechanism translates the squeezing force into an irising movement of blades 5. This irising movement closes blades 5 across opening 3, much as a camera shutter irises closed, cutting the part of a cigar placed in opening 3.

In more detail, squeeze bar 6 is slidably mounted in housing 2. Part of squeeze bar 6 extends out of housing 2, and part of squeeze bar 6 protrudes into housing 2. Guides 7 extend from squeeze bar 6 and flanges 8 extend from housing 2. Guides 7 receive flanges 8, thereby restricting squeeze bar 6 to substantially linear movement.

Squeeze bar springs 10 run from housing 2 to squeeze bar 6 and pull in opposition to a squeezing force applied to squeeze bar 6. Thus, when no such force is applied, squeeze bar springs 10 hold cigar cutter 1 in an "open" position.

As further shown in FIGS. 1 and 2, the mechanism that translates the squeezing force into an irising movement of blades 5 includes rings 11. The inside diameters of rings 11 are less than that of opening 3. Restraining pins 12 and lips 13 of housing 2 that encircle opening 3 hold rings 11 substantially in place.

The end of the part of squeeze bar 6 that protrudes into housing 2 is forked so as to sandwich rings 11. Squeeze bar pins 15 extend from rings 11 and pass through slots 17 in the forked end of squeeze bar 6. By means of this arrangement, an inward movement of squeeze bar 6 causes rings 11 to rotate. In FIG. 1, this rotation would be counter-clockwise.

Ring springs 20 run from rings 11 to certain of restraining pins 12. Ring springs 20 oppose the rotation of rings 11 that is caused by an inward movement of squeeze bar 6, thereby assisting squeeze bar springs 10 in holding cigar cutter 1 in the "open" position.

Blade pins 21 connect rings 11 and pass through slots 22 in blades 5. In this embodiment, blades 5 are mounted on pivot pins 23. By means of this arrangement, the rotation of rings 11 swings blades 5 on pivot pins 23. Depending on the direction of this rotation, blades 5 iris open or closed across opening 3. In FIG. 1, a counter-clockwise rotation of rings 11 would iris blades 5 closed.

In sum, a squeezing force applied to cigar cutter 1 moves squeeze bar 6 inward, rotating rings 11, which in turn iris blades 5 closed to cut a cigar placed in opening 3. When the squeezing force is removed, squeeze bar springs 10 and ring springs 20 return cigar cutter 1 to the "open" position.

Figure 3:
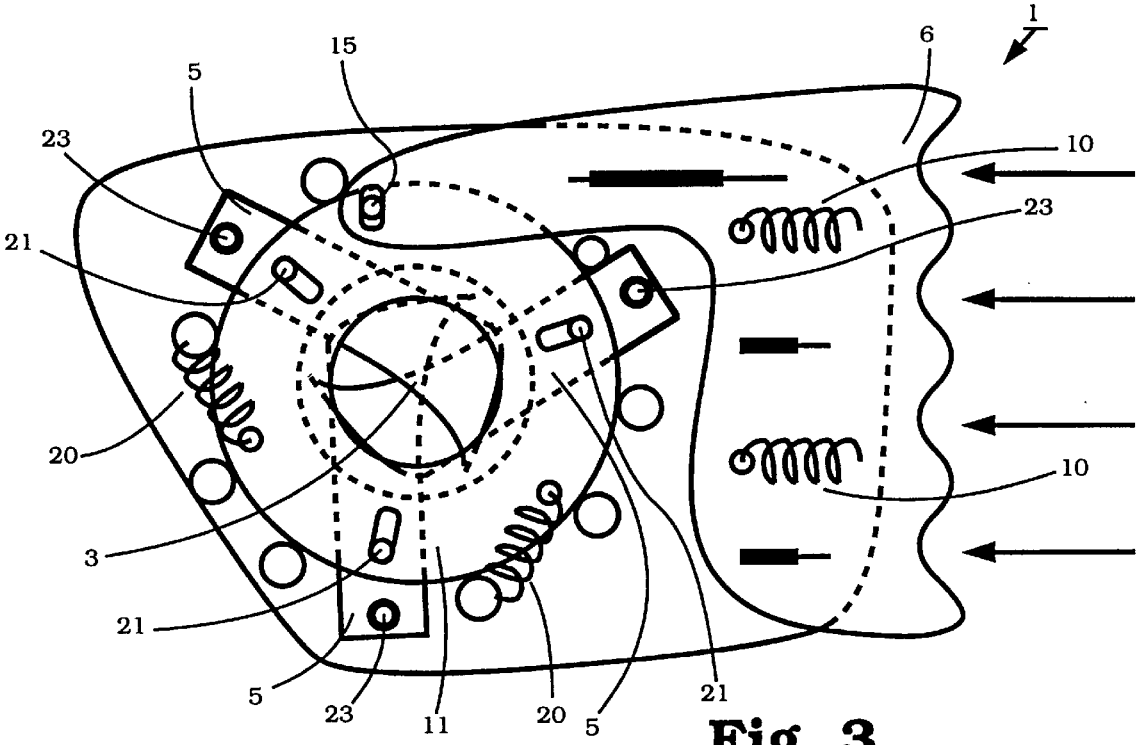
FIG. 3 is a cut-away view of the cigar cutter of FIG. 1 with the blades irised closed.

FIG. 3 is a cut-away view of cigar cutter 1 of FIG. 1 with blades 5 irised closed. A squeezing force has moved squeeze bar 6 inward. The movement of squeeze bar 6 has moved squeeze bar pins 15, thereby rotating rings 11. The rotation of rings 11 has moved blade pins 21, thereby irising blades 5 closed on pivot pins 23 across opening 3. In addition, squeeze bar springs 10 and ring springs 20 have been extended. Thus, when the squeezing force is removed, squeeze bar springs 10 and ring springs 20 will return cigar cutter 1 to the "open" position depicted in FIGS. 1 and 2.

Figure 4:
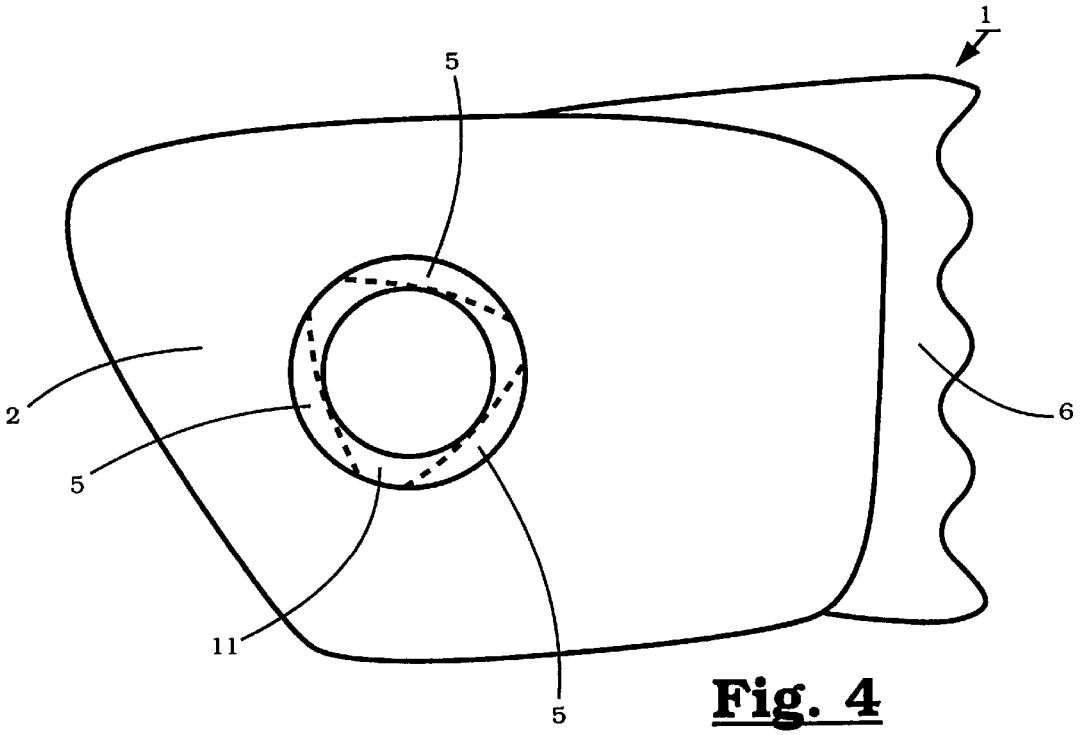
FIG. 4 is a view of the outward appearance of the cigar cutter of FIG. 1.

FIG. 4 is a view of the outward appearance of cigar cutter 1 of FIG. 1. Housing 2 covers almost all of the moving components described above. Only squeeze bar 6 and rings 11 are visible. Note that in the "open" position, rings 11 completely mask blades 5. Thus, a cigar can be easily inserted into opening 3 without catching the cigar on the edges of blades 5. Obviously, when cigar cutter 1 is closed, blades 5 iris closed across opening 3.

Figure 5:
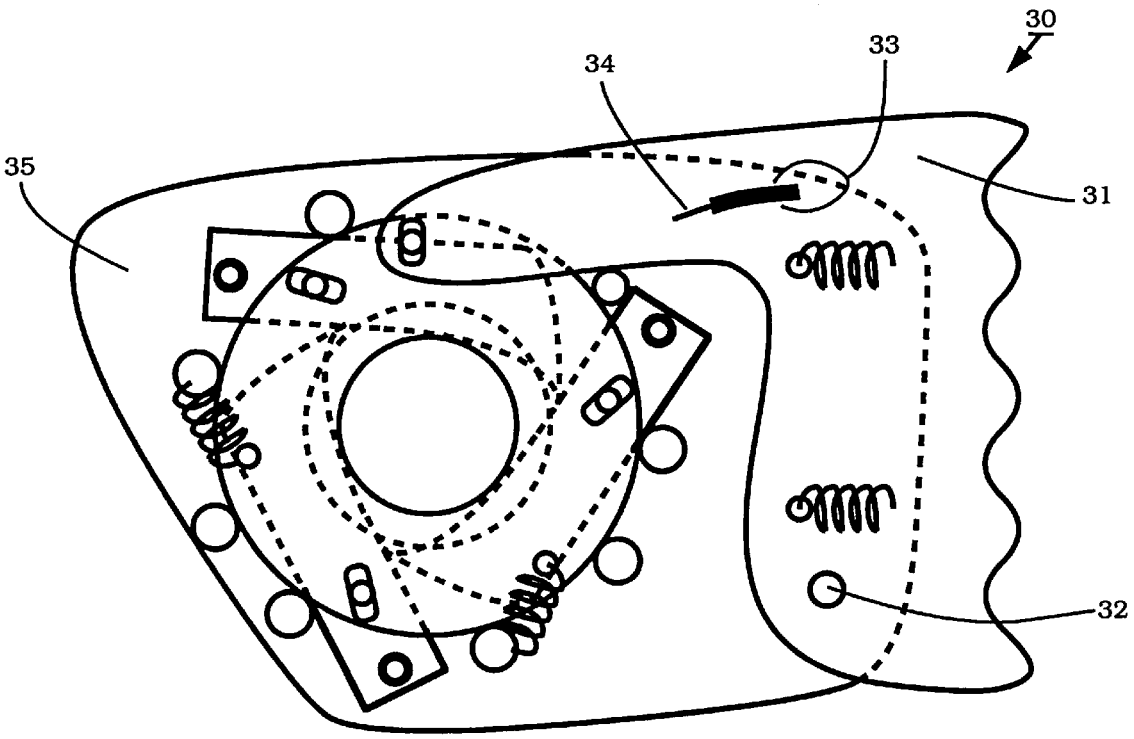
FIG. 5 is a cut-away view of a cigar cutter illustrative of a second embodiment according to the invention with a hinged squeeze bar.
Figure 6:
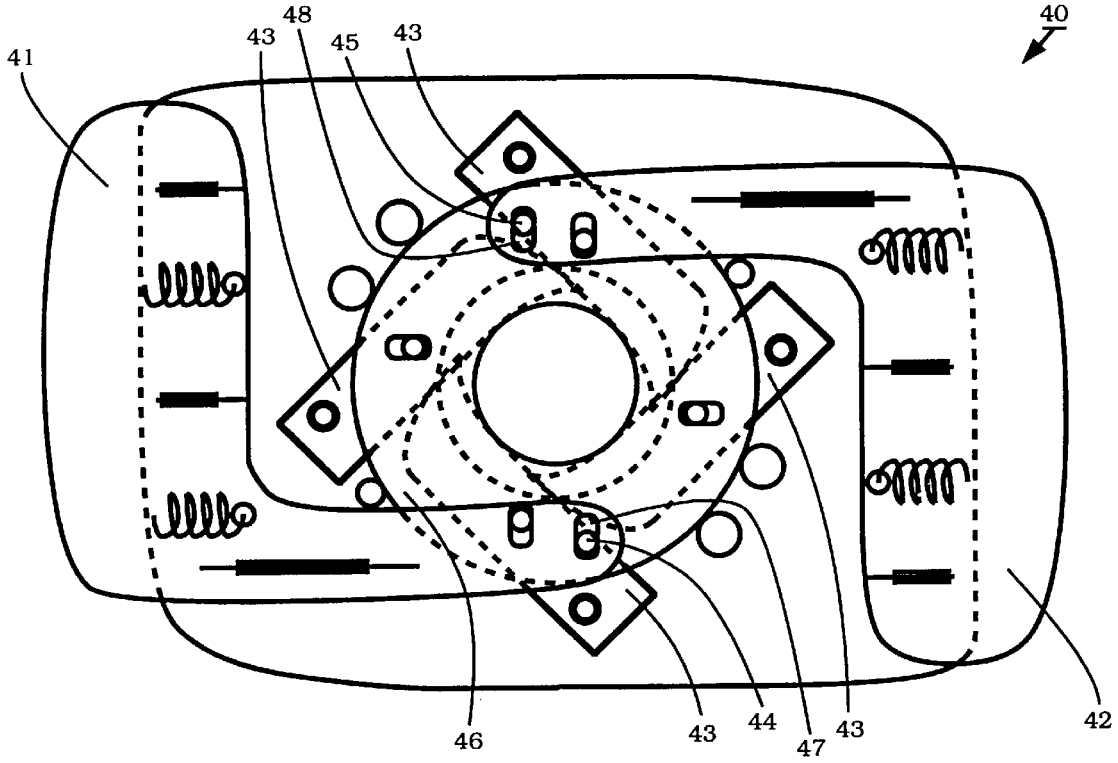
FIG. 6 is a cut-away view of a cigar cutter illustrative of a third embodiment according to the invention with two squeeze bars.

FIG. 5 is a cut-away view of cigar cutter 30 illustrative of a second embodiment according to the invention with hinged squeeze bar 31. This embodiment is substantially similar to the embodiment of FIG. 1, except that hinged squeeze bar 31 swings on hinge pin 32 instead of sliding in a substantially linear movement. Accordingly, guides 33 that extend from hinged squeeze bar 31 and flanges 34 that extend from housing 35 are both curved. Guides 33 receive flanges 34, thereby guiding squeeze bar 31 as it swings on hinge pin 32, FIG. 6 is a cut-away view of cigar cutter 40 illustrative of a third embodiment according to the invention with two squeeze bars 41 and 42. The mechanism that translates a squeezing force applied to squeeze bars 41 and 42 into an irising movement of blades 43 is substantially similar to the one described with respect to cigar cutter 1 of FIG. 1. The main exception is that squeeze bar pins 44 and 45 extend from rings 46 and pass through slots 47 and 48 respectively in squeeze bars 41 and 42. Note that squeeze bars 41 and 42 could also be hinged in a manner similar to hinged squeeze bar 31 of cigar cutter 30 in FIG. 5.

Cigar cutter 40 of FIG. 6 is also illustrative of an alternative configuration of blades 43. Namely, cigar cutter 40 has four blades 43 that iris closed, as opposed to three blades 5 of cigar cutter 1 of FIG. 1. In fact, any reasonable number of blades can be accommodated by the mechanisms of any of the cigar cutters of the invention, with the major limitation being the increase in bulk and mechanical complexity resulting from an increase in the number of blades.

Figure 7:
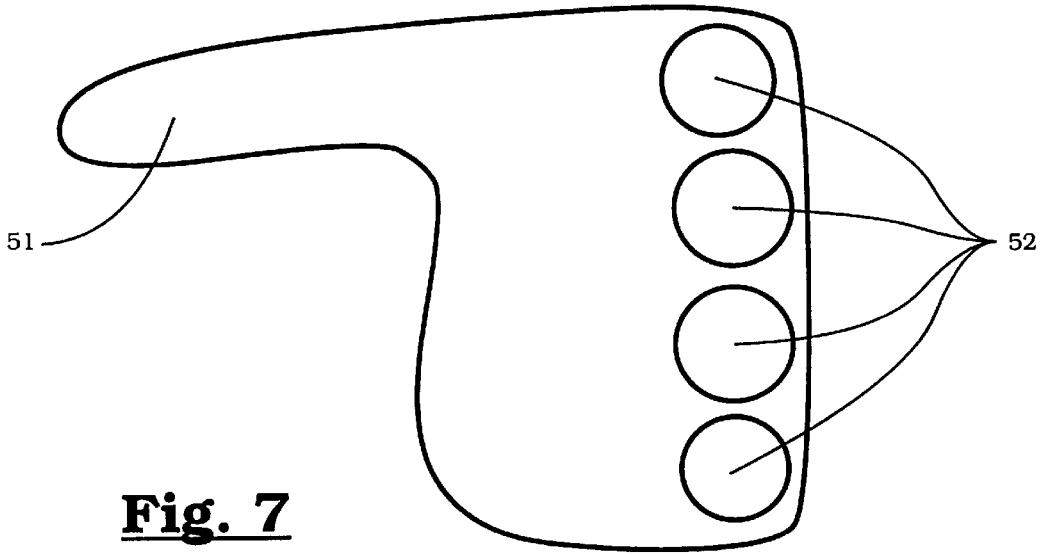
FIG. 7 is a view illustrative of an alternative embodiment of a squeeze bar according to the invention.

FIG. 7 is a view illustrative of an alternative embodiment of a squeeze bar according to the invention. Alternative squeeze bar 51 has finger holes 52. Alternative squeeze bar 51 is suitable for use with any of the cigar cutters described above.

Figure 8:
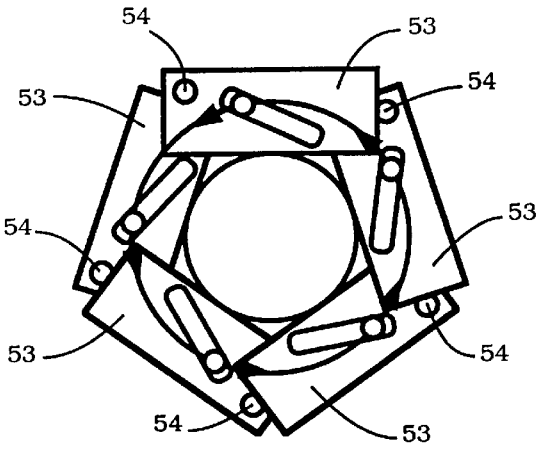
FIGS. 8, 9, 10 and 11 are views illustrative of some alternative blade configurations according to the invention.
Figure 9:
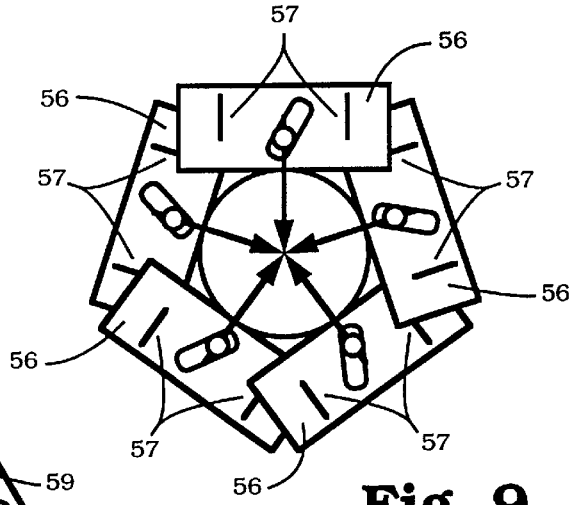
Figure 10:
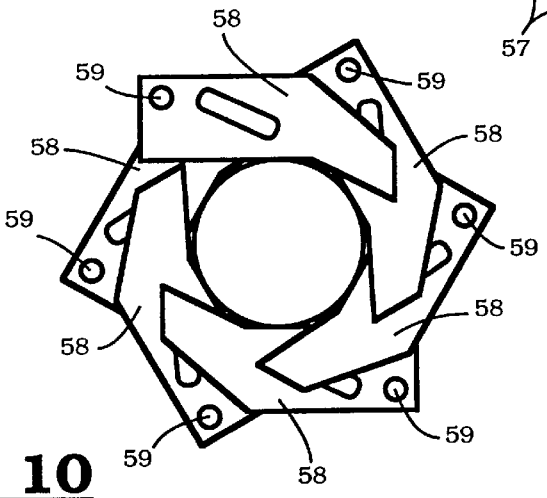
Figure 11:
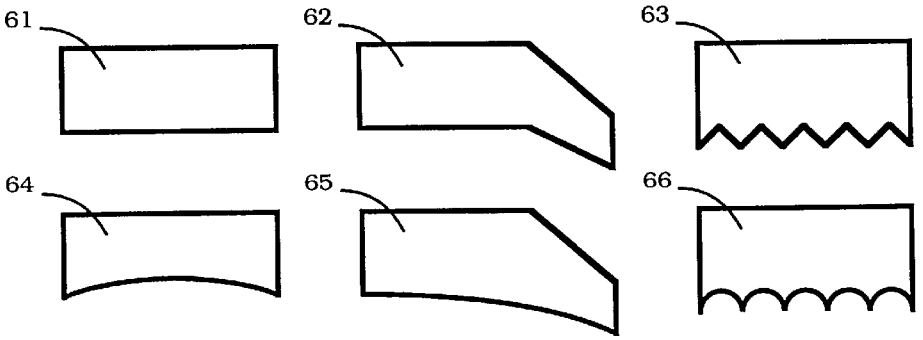

FIGS. 8, 9, 10 and 11 are views illustrative of some alternative blade configurations according to the invention. FIG. 8 shows five blades 53 mounted on pivot pins 54. FIG. 9 shows five blades 56 restricted to substantially linear movement by guides 57. FIG. 10 shows six blades 58 mounted on pivot pins 59. The cutting edge of each of blades 58 includes a bend. In a like manner, the blades used for the cigar cutters of the invention can have many different shapes. These shapes include but are not limited to those shown in FIG. 11: a straight edged blade 61, a bent edged blade 62, a sawtoothed blade 63, a curved edged blade 64, an asymmetrically curved blade 65, and a curved serrated blade 66.

Any type of suitable material can be used to construct the cigar cutters of the invention. In the preferred embodiment, the majority of components are constructed from metal. As one alternative, the housing and all or part of the squeeze bar(s) can be made from plastic. As another alternative, all components, except possibly the blades, can be made from a suitably tough plastic. In fact, even the blades can be made from such a material as long as the material will hold an edge. In addition, any other materials can be used as long as they meet the strength and, for the blades, sharpness and edge-holding requirements.

While this invention has been described in terms of a cigar cutter, the invention is suitable for cutting many other types of objects, especially those that should be cut without substantial tearing or deformation. An example of such an object is a fiber optic strand. The sizes of the cutters for such objects vary with the sizes of the objects. Alternatively, a general purpose cutter can be adapted for cutting any object that would fit within the opening in the housing. Finally, the invention can be adapted for only partially cutting through an object, such as for stripping wire.

Many variations on the cutters discussed above exist. Therefore, the scope of this invention should be determined by the appended claims and their legal equivalents rather than the foregoing examples.

What is claimed is:

1. A cigar cutter comprising:

a housing with at least an opening for insertion of a cigar, a squeeze bar moveably mounted partially within the housing such that at least a part of the squeeze bar extends out of the housing on a first side of the cutter, and at least three blades, the squeeze bar connected to the blades such that when a squeezing force is applied so as to squeeze the squeeze bar toward a second side of the cutter substantially opposite the first side of the cutter across the opening, the squeezing force irises the blades closed, thereby cutting the cigar inserted into the opening.

2. The cigar cutter of claim 1, further comprising a second squeeze bar, the second squeeze bar moveably mounted partially within the housing such that at least a part of the second squeeze bar extends out of the housing on the second side of the cutter, the second squeeze bar connected to the blades such that when the squeezing force is applied so as to squeeze the squeeze bar toward the second squeeze bar and the second squeeze bar toward the squeeze bar, the squeezing force irises the blades closed.

3. The cigar cutter of claim 2, wherein the squeeze bar and the second squeeze bar are slidably mounted such that the squeeze bar and the second squeeze bar slide in substantially linear movements.

4. The cigar cutter of claim 2, wherein the squeeze bar and the second squeeze bar are mounted on hinge pins.

5. The cigar cutter of claim 2, wherein the squeeze bar, the second squeeze bar and the housing are of a size such that the cigar cutter fits within a single hand.

6. The cigar cutter of claim 1, wherein the blades are mounted on pivot pins such that the blades iris closed by swinging on the pivot pins across at least part of the opening.

7. The cigar cutter of claim 1, wherein the blades are slidably mounted such that the blades iris closed by sliding across at least part of the opening.

8. The cigar cutter of claim 1, wherein the squeeze bar is slidably mounted such that the squeeze bar slides in a substantially linear movement.

9. The cigar cutter of claim 1, wherein the squeeze bar is mounted on a hinge pin.

10. The cigar cutter of claim 1, wherein the squeeze bar and the housing are of a size such that the cigar cutter fits within a single hand.

11. The cigar cutter of claim 1, wherein the squeeze bar is biased such that when no squeezing force is applied, the blades tend to iris open.

12. The cigar cutter of claim 11, wherein the squeeze bar is biased with at least one spring.

13. A cigar cutter comprising:

a housing with at least an opening large enough for at least partial insertion of a cigar, a squeeze bar moveably mounted partially within the housing such that at least a part of the squeeze bar extends out of the housing on a first side of the cutter, a mechanism connected to the squeeze bar, and at least three blades connected to the mechanism, the squeeze bar and the mechanism arranged such that when a squeezing force is applied so as to squeeze the squeeze bar toward a second side of the cutter substantially opposite the first side of the cutter across the opening, the mechanism translates a movement of the squeeze bar into an irising movement of the blades, thereby cutting the cigar if the cigar is inserted into the opening.

14. The cigar cutter of claim 13, further comprising a second squeeze bar moveably mounted partially within the housing such that at least a part of the second squeeze bar extends out of the housing on the second side of the cutter, the second squeeze bar also connected to the mechanism.

15. The cigar cutter of claim 14, wherein the mechanism comprises:

two rings that sandwich the blades, at least one squeeze bar pin extending from at least one of the two rings and passing through the squeeze bar, at least one other squeeze bar pin extending from at least one of the two rings and passing through the second squeeze bar, and at least three blade pins, one blade pin for each of the blades, each blade pin connecting the two rings and passing through at least one of the blades, wherein movement of the squeeze bar and the second squeeze bar moves the squeeze bar pins, movement of the squeeze bar pins moves the rings, movement of the rings moves the blade pins, and movement of the blade pins irises the blades.

16. The cigar cutter of claim 13, wherein the squeeze bar and the housing are of a size such that the cigar cutter fits within a single hand.

17. The cigar cutter of claim 13, wherein the mechanism comprises:

two rings that sandwich the blades, at least one squeeze bar pin extending from at least one of the two rings and passing through the squeeze bar, and at least three blade pins, one blade pin for each of the blades, each blade pin connecting the two rings and passing through at least one of the blades, wherein movement of the squeeze bar moves the squeeze bar pin, movement of the squeeze bar pin rotates the rings, rotation of the rings moves the blade pins, and movement of the blade pins irises the blades.

18. A cutter comprising:

a housing with at least an opening adapted for insertion of an object, a squeeze bar moveably mounted partially within the housing such that at least a part of the squeeze bar extends out of the housing on a first side of the cutter, a mechanism connected to the squeeze bar, and at least three blades connected to the mechanism, the squeeze bar and the mechanism arranged such that when a squeezing force is applied so as to squeeze the squeeze bar toward a second side of the cutter substantially opposite the first side of the cutter across the opening, the mechanism translates a movement of the squeeze bar into an irising movement of the blades, thereby at least partially cutting the object if the object is inserted into the opening.

19. The cutter of claim 18, wherein the mechanism comprises:

two rings that sandwich the blades, at least one squeeze bar pin extending from at least one of the two rings and passing through the squeeze bar, and at least three blade pins, one blade pin for each of the blades, each blade pin connecting the two rings and passing through at least one of the blades, wherein movement of the squeeze bar moves the squeeze bar pin, movement of the squeeze bar pin rotates the rings, rotation of the rings moves the blade pins, and movement of the blade pins irises the blades.

* * * * *